US008007007B1

(12) United States Patent
Ngan

(10) Patent No.: US 8,007,007 B1
(45) Date of Patent: Aug. 30, 2011

(54) MULTILEAF BACK LOADING AND BACK UNLOADING BINDER FOR MENUS, PHOTOS, CARDS AND THE LIKE

(76) Inventor: Chi Lung Ngan, Edison, NJ (US)

( * ) Notice: Subject to any disclaimer, the term of this patent is extended or adjusted under 35 U.S.C. 154(b) by 441 days.

(21) Appl. No.: 12/314,414

(22) Filed: Dec. 10, 2008

(51) Int. Cl.
*B42D 3/00* (2006.01)

(52) U.S. Cl. ..... 281/36; 281/22; 281/38

(58) Field of Classification Search ..... 281/22, 281/36, 38

See application file for complete search history.

(56) References Cited

U.S. PATENT DOCUMENTS

| | | | | |
|---|---|---|---|---|
| 164,249 | A | | 6/1875 | Arms |
| 683,853 | A | | 10/1901 | Forbes |
| 1,988,998 | A | | 1/1935 | Cornish |
| 2,068,011 | A | * | 1/1937 | Engel ..... 40/405 |
| 2,359,473 | A | * | 10/1944 | Fry ..... 281/19.1 |
| 2,558,996 | A | * | 7/1951 | Ullmann ..... 281/20 |
| 4,267,655 | A | | 5/1981 | Holson |
| 5,066,182 | A | * | 11/1991 | Stonebraker et al. ..... 412/3 |
| 5,135,401 | A | | 8/1992 | Schorrig |
| 5,323,553 | A | | 6/1994 | Candido |
| 5,839,762 | A | * | 11/1998 | Ho-Chou ..... 281/38 |
| 6,061,943 | A | | 5/2000 | Pepys |
| 6,558,099 | B2 | * | 5/2003 | Mendoza et al. ..... 412/1 |
| 6,742,809 | B2 | * | 6/2004 | Frosig et al. ..... 281/21.1 |
| 2002/0089167 | A1 | * | 7/2002 | Peleman ..... 281/36 |

* cited by examiner

*Primary Examiner* — Gary C Hoge
(74) *Attorney, Agent, or Firm* — Shlesinger, Arkwright & Garvey LLP

(57) ABSTRACT

A multileaf back loading and back unloading binder for menus, photos, cards and the like which includes front and back covers and a series of transparent interconnected pockets between the front and back covers and a removable and replaceable binder backing for providing ready access from the rear to the pockets.

9 Claims, 4 Drawing Sheets

MULTILEAF BACK LOADING AND BACK UNLOADING BINDER FOR MENUS, PHOTOS, CARDS AND THE LIKE

THE INVENTION

This invention relates to a multileaf back loading and back unloading binder for menus, photos, cards and the like providing a series of transparent interconnected pockets between the front and rear covers which provide ready access only from the rear of the binder thereby avoiding damage to the articles by frequent handling.

BACKGROUND AND HISTORICAL DEVELOPMENT

Binders and albums of transparent nature for holding menus, photos, cards and the like has been used for well over a hundred and fifty years. Arms U.S. Pat. No. 164,249 is an early 1875 patent showing the series of interconnected pockets. The loading is from the side as is Holson U.S. Pat. No. 4,267,655.

Schorrig U.S. Pat. No. 5,135,401 does provide an album with pockets but the loading is from the front or sides.

Forbes U.S. Pat. No. 683,853 provides and album which may be loaded and unloaded from the sides.

Pepys U.S. Pat. No. 6,061,943 shows an album which is loaded from near the back but the front and rear panels of each pocket are of different length so that loading multiple items must be done by flipping one pocket after the other.

Candido U.S. Pat. No. 5,323,553 in affect presents the same problem of loading as does Pepys when you have multiple leaves.

Cornish U.S. Pat. No. 1,988,998 provides for side loading and the binder is stitched up so that it would be impossible to load and unload from the rear.

OBJECTS AND SUMMARY

It is an object of this invention to provide a binder, album or portfolio or the like in which the articles to be mounted or removed from therein may be readily inserted or removed from the rear without having to page or flip one pocket after another.

Another object of this invention is to provide a back loading and unloading binder for menus, photos, cards and the like which protects the article from side, front and rear subsequent to mounting of the articles.

Still a further object of this invention is to provide a multileaf back loading and back unloading binder which can be made from a single long sheet of transparent material.

Another object of this invention is to provide a multileaf back loading and back unloading binder which is inexpensive to manufacture and which can be viewed from both sides of the pocket in which an article is placed.

A further object of this invention is to provide a multileaf back loading and back unloading binder which has a readily removable and replaceable backing for easy access to the pockets from the rear and provides protection after the articles have been loaded.

Still another object of this invention is to provide a multileaf back loading and back unloading binder which is light weight and easily handled.

In summary, this invention relates to a multileaf back loading and back unloading binder for menus, photos, cards and the like which reduces wear and tear on the articles inserted in the pockets as well as wear and tear on the binder itself. These and other objects will be apparent from the following description and the accompanying drawings which are as follows.

DETAILED DESCRIPTION OF THE INVENTION

FIGS. 1-6

Figure 2:
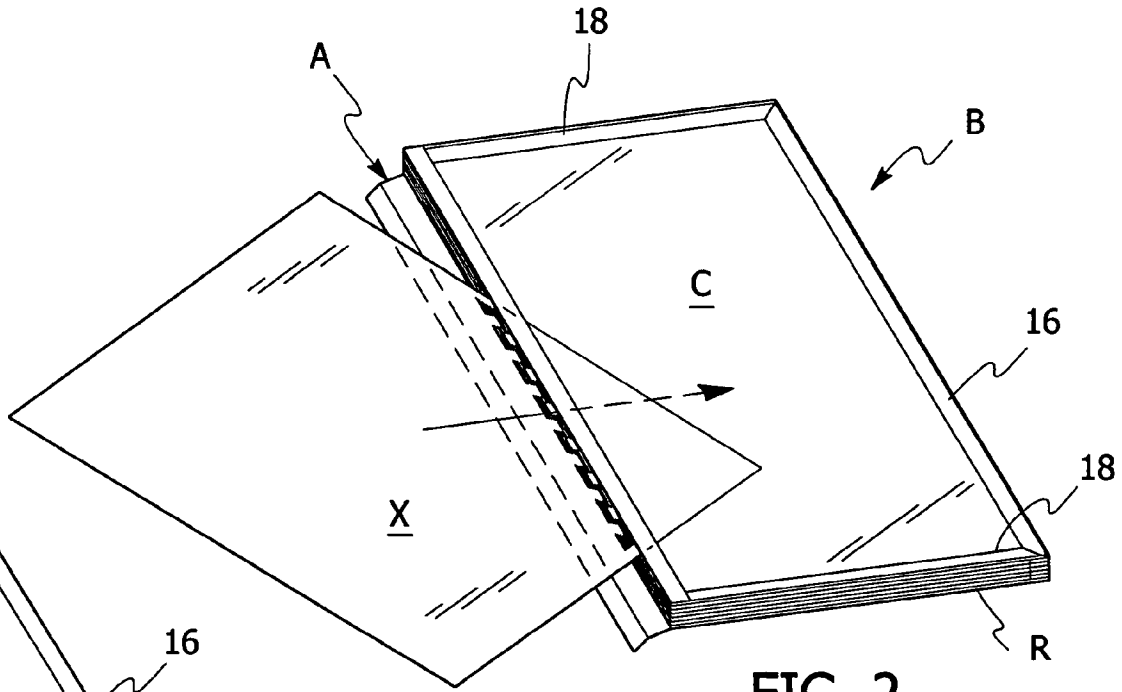
FIG. 2 is a perspective view showing the binder with the backing opened up to permit the article to be inserted into a pocket from the rear.
Figure 1:
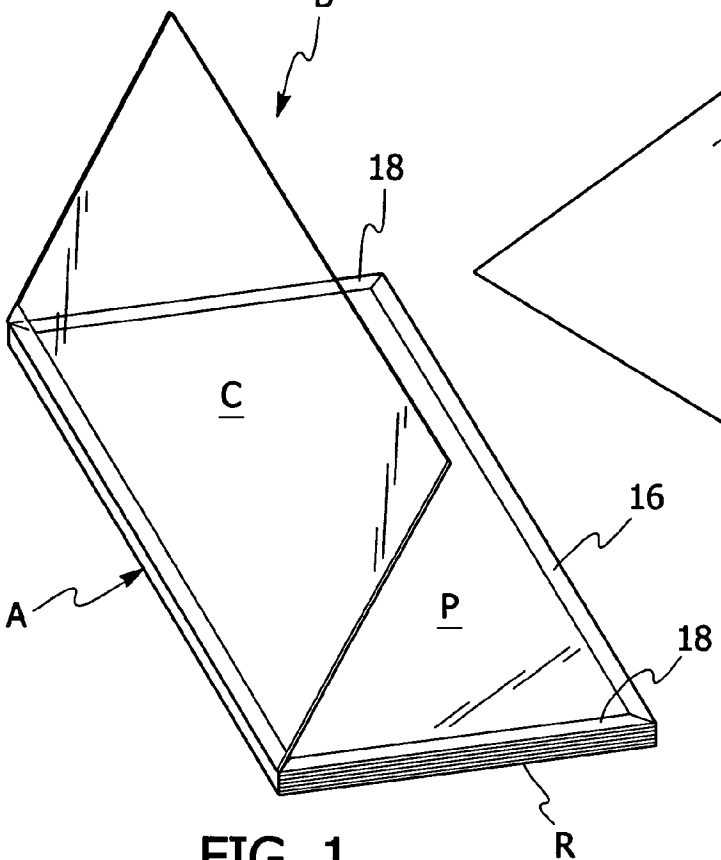
FIG. 1 is a perspective view of the binder showing the transparent cover in open position.
Figure 4:
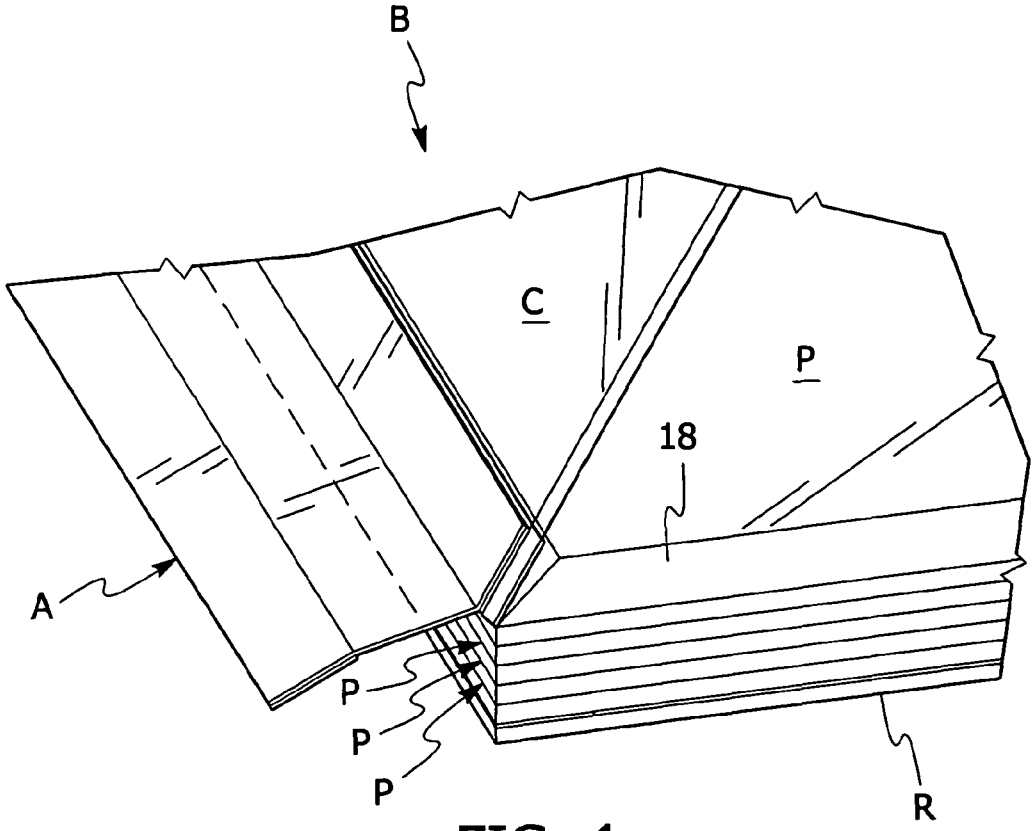
FIG. 4 is a fragmentary perspective view showing the front cover in open position and backing in open position.
Figure 5:
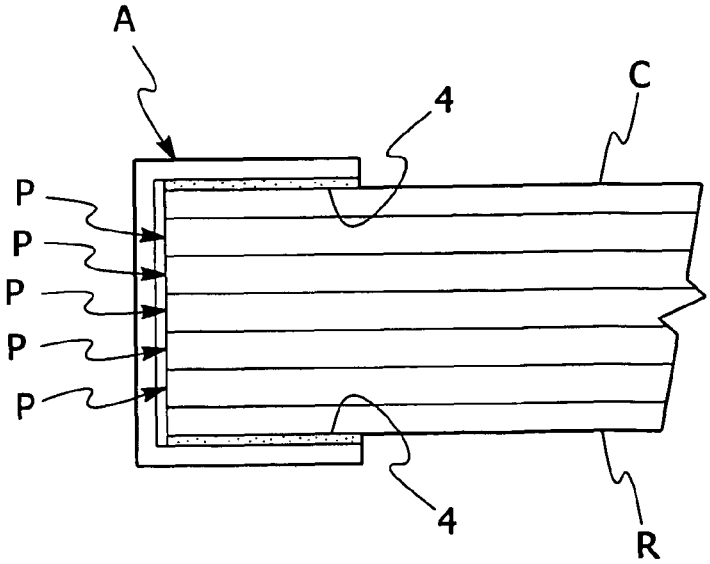
FIG. 5 is an enlarged side elevational view showing the backing in closed position.

In FIG. 1, the binder B is shown with the front cover C in raised position over the pockets P. The backing strip A is attached to the front cover C and the back cover R and circumscribes the back of the pockets P. Cover R is not secured or sealed to the back of the pockets P. The front and back covers C and R may be transparent, translucent or opaque. The front and back covers C and R may be relatively stiff material so as to avoid crimping or creasing. In FIG. 2, the backing strip A is shown removed from the front cover C while attached to the back cover R so as to expose the rear of a pocket P for insertion of an article X such as a menu, photo, card to the like.

Figure 3:
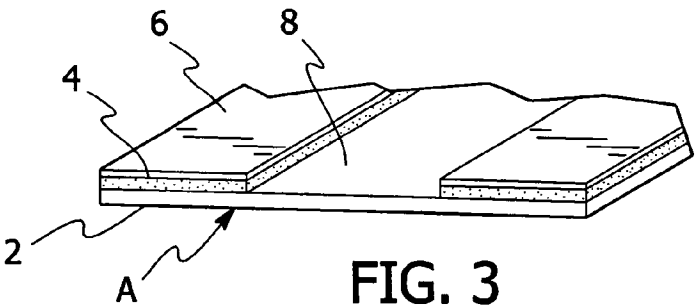
FIG. 3 is an enlarged fragmentary perspective view of the backing prior to positioning on the binder.

As best shown in FIG. 3, the backing strip A comprises a base member 2 having spaced pressure sensitive adhesive 4 along its sides. Peel-off strips 6 are provided to protect the adhesive 4 prior to positioning the backing strip A. Strip A includes a non-adhesive central portion 8. When the backing strip A is applied to the front and rear back covers C and R, the pressure sensitive adhesive 4 maintains the backing strip A in position so that the central portion 8 covers but does not engage the pockets P. The pressure sensitive adhesive 4 is of the type that it will release from the front or back covers C and R for insertion of an article X and can be easily repositioned and secured to either the front or back covers C and R subsequent to insertion or removal of an article X. Other types of backing strips may be used such as Velcro applied to the covers and strips or tongue and groove devices which snap on but release by lifting or zipping.

Figure 6:
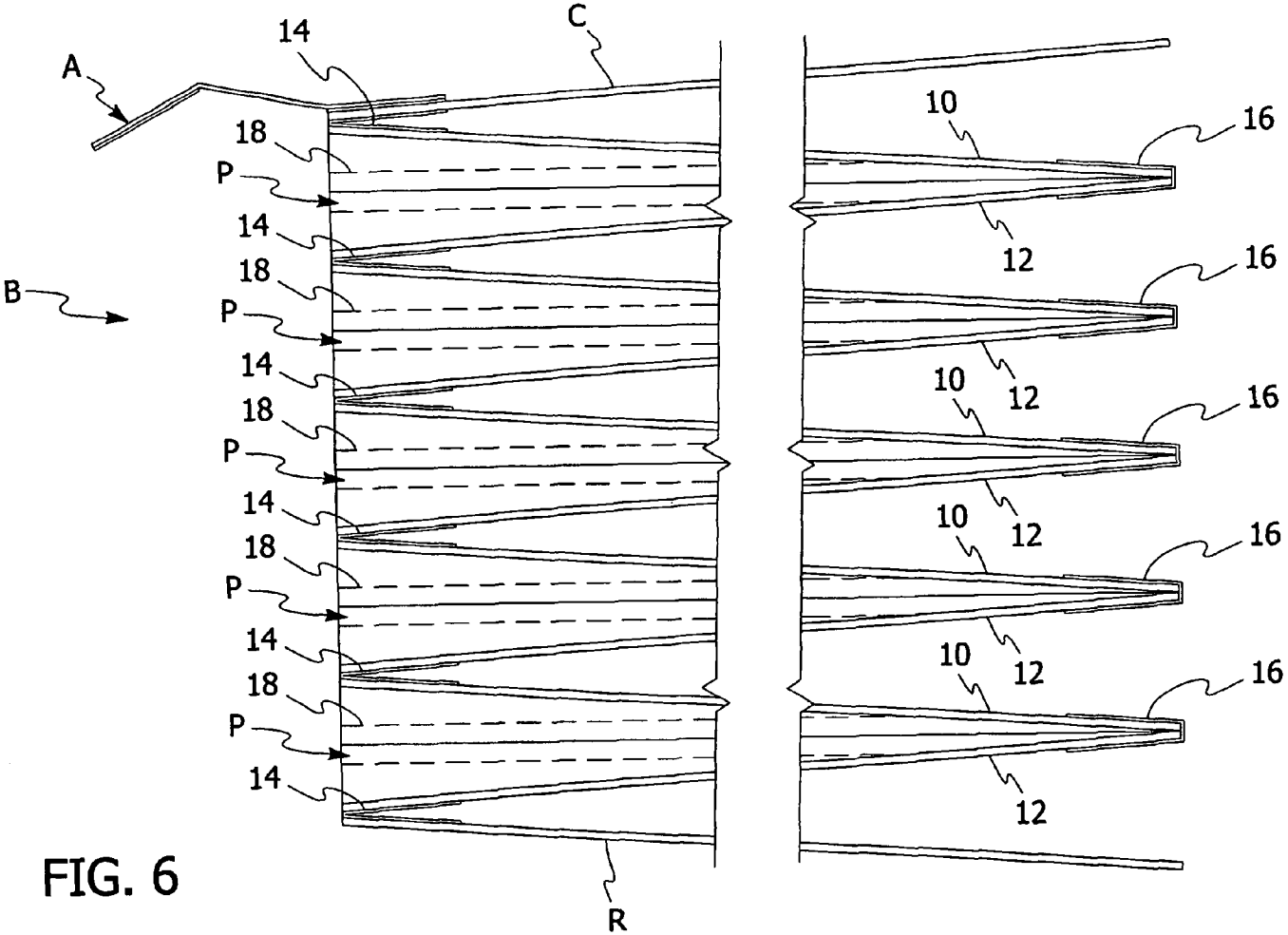
FIG. 6 is an enlarged exploded view in cross section showing the pockets in open position to receive an article.

As best shown in FIG. 6, the pockets P comprise front and rear panels 10 and 12. Hinge strips 14 are provided between successive pockets P. Hinge strips 16 seal front panels 10 to rear panels 12 at the top of the pockets P. Hinge strips 14 connect the pockets P at the bottom of the pockets P. The sides of the panels 10 and 12 are secured together by hinge strips 18.

The hinge strips 14, 16 and 18 are secured to the panels 10 and 12 by permanent adhesive not of the pressure sensitive removable type as on the backing strip A.

FIG. 7

Figure 7:
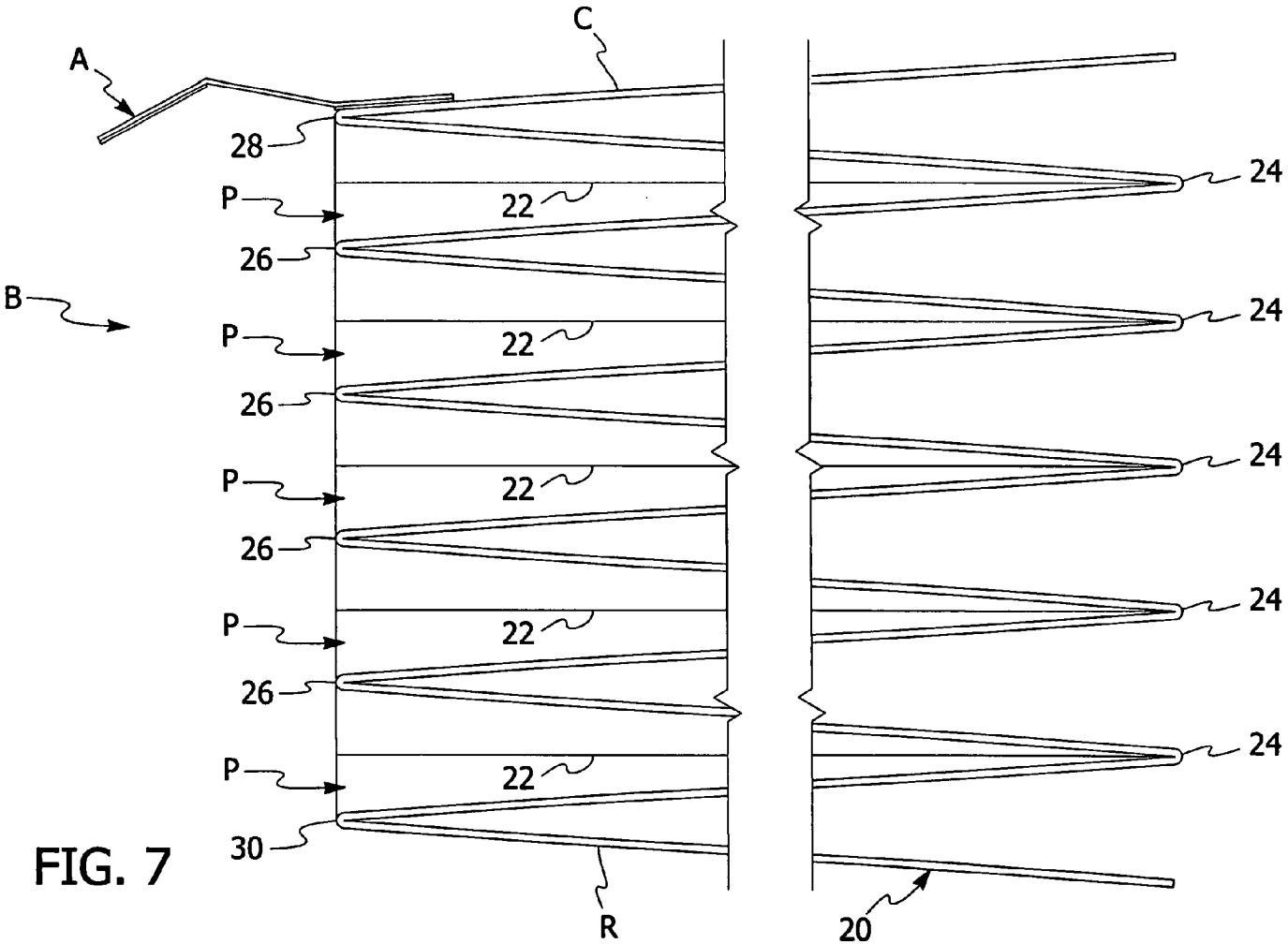
FIG. 7 is an exploded cross sectional view of a modification of the invention similar to FIG. 6.

In FIG. 7, the binder B comprises a series of transparent interconnected pockets P having heat sealed side edges 22 and heat formed top hinges 24. Pocket heat formed hinges 26 connect the pockets P. Front and back covers C and R are integral with the pockets and are provided with heat formed hinges 28 and 30. Thus a single sheet of material can be used to form the covers C and R as well as the pockets P.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A multileaf back loading and back unloading binder for menus, photos, cards and the like comprising:

a) front and back covers;

b) a series of transparent interconnected pockets;

c) said pockets each having coextensive front and rear panels;

d) said front and rear panels of each of said pockets having top, bottom and left and right side margins;

e) said front and rear panels being sealed together along their top and left and right side margins to form said pockets;

f) said front and rear panels bottom margins being unsealed to provide and opening into each pocket for loading and unloading menus, photos, cards and the like;

g) said series of pockets being interconnected at said panels bottom margins;

h) said series of pockets including a first and a last pocket;

i) said first pocket connected to said front cover;

j) said last pocket connected to said back cover;

k) said front and back covers being substantially coextensive with said pockets' front and rear panels; and l) a removable and replaceable binder backing secured to said front and rear covers and abutting and unsecured to said pockets' panels' unsealed bottom margins.

2. A multileaf back loading and back unloading binder as in claim 1 and wherein:

a) said removable and replaceable binder backing includes a flexible binder strip having spaced pressure sensitive adhesive along sides thereof.

3. A multileaf back loading and back unloading binder as in claim 1 and wherein:

a) said removable and replaceable binder backing includes a flexible binder strip;

b) said binder strip having side edges provided with pressure sensitive adhesive secured to said front and back covers;

c) said binder strip having a non-adhesive central portion unsecured to said pockets' panels' unsealed bottom margins.

4. A multileaf back loading and back unloading binder as in claim 1 and wherein:

a) said removable and replaceable binder backing includes a peel-off strip.

5. A multileaf back loading and back unloading binder as in claim 1 and wherein:

a) said front and rear panels are transparent plates, and b) said plates include binding strips for interconnecting said pockets and for sealing said panels right and left side and top margins, and for connecting said first pocket to said front cover and said last pocket to said back cover.

6. A multileaf back loading and back unloading binder as in claim 1 and wherein:

a) said series of transparent interconnected pockets are a single strip of transparent material.

7. A multileaf back loading and back unloading binder as in claim 6 and wherein:

a) said single strip of transparent material includes said front and back covers.

8. A multileaf back loading and back unloading binder as in claim 1 and wherein:

a) said binder pockets can be individually paged open without flipping other pockets.

9. A multileaf back loading and back unloading binder as in claim 1 and wherein:

a) said panels are of clear plastic material.

* * * * *